US005431609A

United States Patent [19]

Panagiotopoulos et al.

[11] Patent Number: 5,431,609

[45] Date of Patent: Jul. 11, 1995

[54] ELECTRICAL RESISTANCE EXERCISE DEVICE WITH LIFT ASSISTANCE

[76] Inventors: Anastasios Panagiotopoulos, 23-33 3rd Ave., Astoria, N.Y. 11106; Razvan H. Cristescu, 31-80 45th St., Apt. #5, Long Island City, N.Y. 11103

[21] Appl. No.: 728,272

[22] Filed: Jul. 11, 1991

[51] Int. Cl.[6] ..... A63B 21/005; A63B 71/00

[52] U.S. Cl. ..... 482/5; 482/8; 482/9; 482/900; 482/903

[58] Field of Search ..... 482/903, 901, 900, 1, 482/5, 8, 9, 93, 94, 99, 102, 904

[56] References Cited

U.S. PATENT DOCUMENTS

| | | | |
|---|---|---|---|
| 4,610,449 | 9/1986 | Diercks . | |
| 4,730,829 | 3/1988 | Carlson | 482/904 |
| 4,746,113 | 5/1988 | Kissel . | |
| 4,765,613 | 8/1988 | Voris | 482/904 |
| 4,828,257 | 5/1989 | Dyer et al. | 482/904 |
| 4,865,315 | 9/1989 | Paterson et al. | 482/5 |
| 4,869,497 | 9/1989 | Stewart et al. | 482/901 X |
| 4,921,224 | 5/1990 | Berroth . | |
| 4,930,770 | 6/1990 | Baker . | |
| 4,934,694 | 6/1990 | McIntosh . | |

*Primary Examiner*—Richard J. Apley
*Assistant Examiner*—John P. Leubecker
*Attorney, Agent, or Firm*—Charles E. Tenko

[57] ABSTRACT

An electronically controlled exercise device which will allow a user engaged in weight lifting to continue to exercise past the point of muscle failure. The disclosed device utilizes and electromagnetically simulated resistance in the form of a DC motor. The user is able to set an initial desired weight (resistance), while a feedback network automatically adjusts and decreases the resistance as the user progresses through a set of exercises and gradually begins to approach muscle failure.

6 Claims, 10 Drawing Sheets

FIG. 1
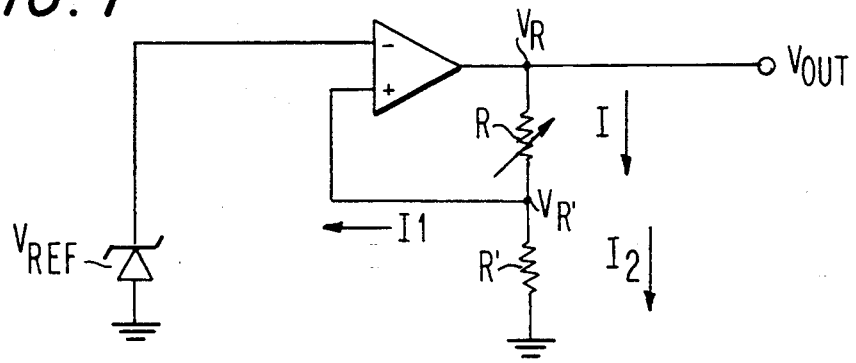
FIG. 2
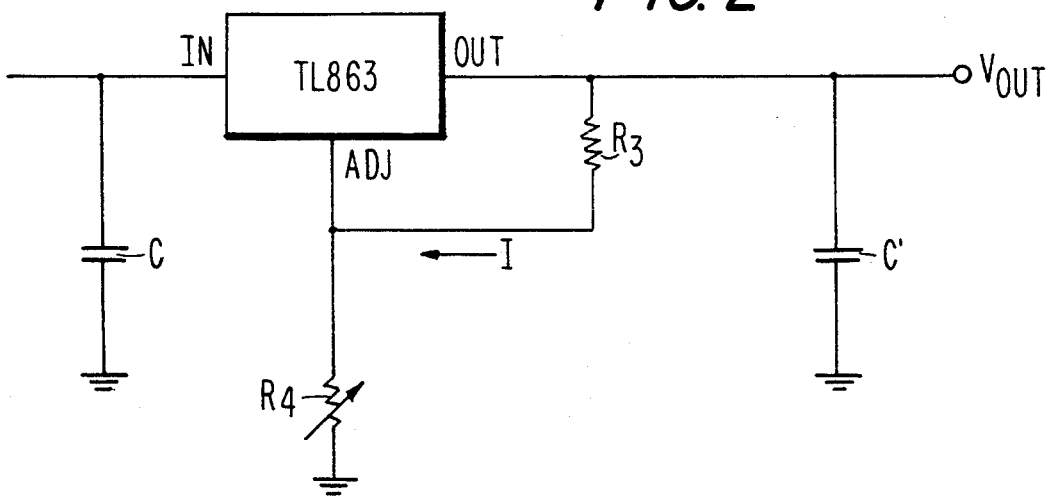
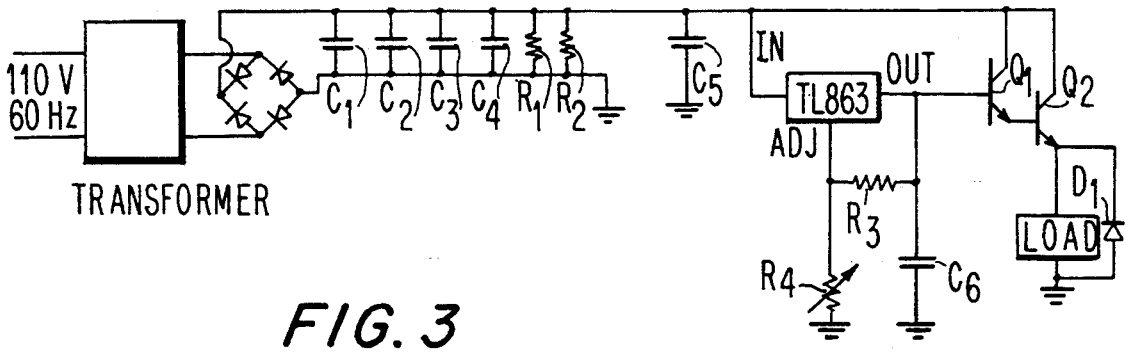
FIG. 3

FIG. 15

| | Keypad Output (after being INVERTED) | Required DEMULTIPLEXER Input |
|---|---|---|
| | 100 80 40 20 10 | 8 4 2 1 |
| 0 | 0 0 0 0 0 | 0 0 0 0 |
| 10 | 0 0 0 0 1 | 0 0 0 1 |
| 20 | 0 0 0 1 0 | 0 0 1 0 |
| 30 | 0 0 0 1 1 | 0 0 1 1 |
| 40 | 0 0 1 0 0 | 0 1 0 0 |
| 50 | 0 0 1 0 1 | 0 1 0 1 |
| 60 | 0 0 1 1 0 | 0 1 1 0 |
| 70 | 0 0 1 1 1 | 0 1 1 1 |
| 80 | 0 1 0 0 0 | 1 0 0 0 |
| 90 | 0 1 0 0 1 | 1 0 0 1 |
| 100 | 1 0 0 0 0 | 1 0 1 0 |
| 110 | 1 0 0 0 1 | 1 0 1 1 |
| 120 | 1 0 0 1 0 | 1 1 0 0 |
| 130 | 1 0 0 1 1 | 1 1 0 1 |
| 140 | 1 0 1 0 0 | 1 1 1 0 |
| 150 | 1 0 1 0 1 | 1 1 1 1 |

ELECTRICAL RESISTANCE EXERCISE DEVICE WITH LIFT ASSISTANCE

BACKGROUND OF THE INVENTION

This invention relates generally to the field of exercise devices, and more particularly to a weight training device.

The basic idea of weight training is that it exposes the human body to stimuli to which it is not accustomed. The body adjusts by growing in size so that it can manage a new load. There are several factors that determine the ability of the body to adjust to the new stress imposed upon it. These factors fall into three main categories, namely training, diet, and recuperation.

All of these factors must be met in order for a person to gain strength and endurance. The present invention is directed toward maximizing the first category, e.g. training.

Assume that a person can normally complete ten repetitions with a given weight before reaching failure. If that person performs ten repetitions in each successive training session, no progress will be made since the body has become used to and can handle this degree of resistance. If the person, however, decides to go past muscle failure and complete e.g. two more repetitions with some additional help, bringing his total to twelve repetitions, his body will adjust to this new overload by muscular growth.

It is known in the art in devices of this type to provide for the sensing of the point of muscular failure and the adjusting of the device to lighten the load so that the user can continue. The U.S. Pat. No. to Diercks, Jr., No. 4,610,449, for example, provides for the release of a number of weight plates less than the total in accordance with a predetermined time period established by a cam type timer. The Kissel U.S. Pat. No. 4,746,113 provides for a weight changing system including a body having a plurality of pins which are capable of selectively releasing the weights by pulling the requisite number of pins. It is also known to employ a motor driven variable force device to assist the user without disconnecting the weights as exemplified by the disclosure in the Berroth U.S. Pat. No. 4,921,244.

It is also known to employ computer controlled torque motors without weights for use in exercise devices which are not essentially weight lifting types, as exemplified by the Macintosh U.S. Pat. No. 4,934,694 and the Baker U.S. Pat. No. 4,930,770.

The great bulk of the prior art devises either fail to provide sufficient sensitivity to the user, or are so overly complex in design and fabrication as to be prohibitive in ccst.

SUMMARY OF THE INVENTION

Briefly stated, the invention contemplates the provision of an improved weight training exercise device of the class described in which the above mentioned disadvantages have substantially been eliminated. To this end, the disclosed embodiment eliminates the presence of weight plates altogether, and substitutes a single direct current torque motor which is electronically controlled to provide the exact amount of force necessary to permit the user to continue exercising past the point of initial muscle failure, the device including means for continuously sensing the condition of the user, and substantially instantaneously adjusting the degree of torque to respond to the sensed condition.

This is accomplished principally through the use of a finely controlled power supply to the torque motor, and a digital control network.

BRIEF DESCRIPTION OF THE DRAWING

In the drawings, to which reference will be made in specification;

FIG. 1 is a schematic representation of a voltage regulator forming part of a power supply comprising a part of the disclosed embodiment.

FIG. 2 is a schematic diagram Showing an integrated circuit with external biasing.

FIG. 3 is a schematic diagram of a basic power supply.

FIG. 15 is a chart showing the function of a key pad element forming a part of the device.

DETAILED DESCRIPTION OF THE DISCLOSED EMBODIMENT

Basic Theory

Figure 4:
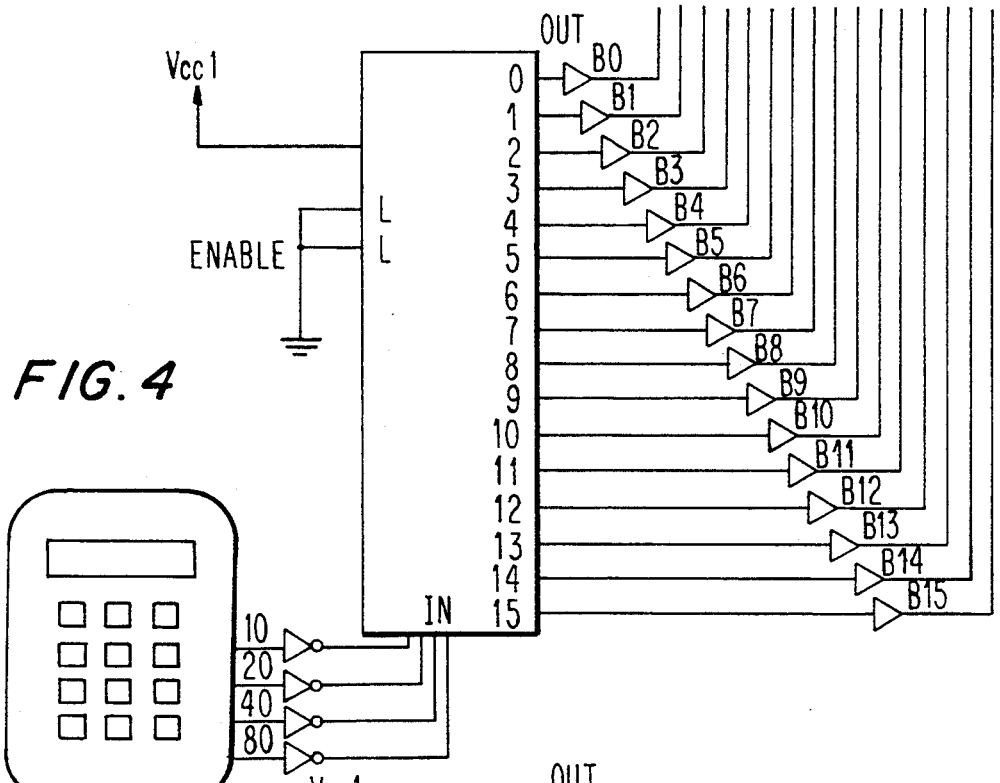
FIG. 4 is a schematic diagram of a basic control network.

As has been mentioned, the disclosed embodiment depends essentially upon a single DC torque motor which delivers the requisite forces to a cable which interconnects the arms of a user with a simulated weight load. The torque motor, in conjunction with a condition sensor is essentially all that needs to be added to a conventional weight exerciser of known type. It is the proper control of the instantaneous delivery of torque of the motor which eliminates the relatively complex electronic hardware which characterizes the bulk of the prior art devices.

It has been determined that the maximum current drawn by a suitable DC motor is five amperes which was observed at stalled torque, so that an adequate power supply must produce currents substantially in excess of that value to prevent any malfunctions.

A principal part of the power supply is an adjustable voltage regulator which may include a known integrated circuit (TL 863) which is capable of delivering output voltages ranging from 1.2 volts up to 100 volts. Referring to FIG. 1, a voltage regulator consists of an operational amplifier with external biasing components.

Ideally, current $I_1$ should be 0, which would cause $I=I_2$ and $$V_{out}=(R+R')I \qquad \text{EQ.1}$$

The second constraint is that ideally, the inverting and non-inverting inputs of the operational amplifier should be at the same potential. This would imply that $$V_{ref} = VR' = IR'$$

or that $$I = \frac{V_{ref}}{R'} \qquad \text{EQ. 2}$$

Inserting equation 2 and equation 1

$$V_{out} = (R + R')I = (R + R')\frac{V_{ref}}{R'} = \left(1 + \frac{R}{R'}\right)V_{ref}$$

By increasing the value of R, different output voltages may thus be obtained. For R=0, this implies that $V_{out}$ is equal to $V_{ref}$, or the minimum output voltage is equal to the reference voltage. For the particular integrated circuit involved, $V_{ref}$ is equal to 1.2 volts.

As indicated above, the integrated circuit may deliver output voltages anywhere between 1.2 volts up to 100 volts if properly biased by a few external components. FIG. 2 shows the integrated circuit with such biasing.

Since R3 is equal to 220 ohms,

I is equal to $V_{ref}/R_3$ which is equal to 1.2/220 which is equal to 5.5mA By adjusting R4, different output voltages may be obtained. For example, if R4 is equal to 1K, then $V_{out}$ is equal to 5.5 (1.220) equals 6.71 volts.

The next requirement of the power supply is an unregulated DC voltage to the input of the voltage regulator. A resulting circuit is shown in FIG. 3.

A transformer is used to step down the normal 110 volt AC line voltage to 44 volts. A 25 ampere bridge rectifier is employed to change the AC voltage to DC. However, the voltage output of the rectifier is not normally pure DC. Therefore a series of capacitors $C_1$-$C_4$ are necessary to filter the output. Large values for the capacitors e.g. 2200uF are necessary due to the fact that a very small load is used which draws a substantial amount of current. Small valued capacitors would discharge a considerable amount between successive peaks from the rectifier, and this would produce unwanted oscillations at the DC level. Resistors R1 and R2 are necessary to insure that the capacitors will discharge once the power is discontinued.

The circuit illustrated in FIG. 3 provides a way of obtaining output voltages ranging from 1.2 volts to 50 volts, a desired range. However, the integrated circuit can deliver a maximum current of only one ampere. Since the load in this case would be drawing currents ranging from 0 amperes to over five amperes, it is necessary to boost the output current capability of the regulator. This is done by adding several output transistors to handle the higher currents.

The output stage of the power supply consists of transistor Q1, a 2N3599, and transistor Q2 a 2N3151. Transistor Q1 is implemented as a driver transistor, used to initially drive the output transistor. The output stage can deliver up to ten amperes at a maximum power of 100 Watts. The driver transistor is responsible for delivering only one ampere at a respective collector-emitter voltage of 50 volts or less. Therefore, the circuit deals with a power dissipation of 50 Watts or less, which is well within the range of the transistor 2N3599. A second component of the output stage consists of the transistor 2N3151 which possesses a maximum power rating of 300 Watts, and current capabilities of up to 50 Amperes. Although this specification is two or three times the true capability of the circuit 2N3151, it is still possible to obtain 15–25 Amperes at approximately 150 Watts, which is more than enough to drive the torque motor. The characteristics of the driver transistor Q1 and the output transistor Q2 are such that the driver transistor exhibits a gain of about 70 at a collector current of one Ampere, while the output transistor Q2 possesses a gain of about 40 at a current of five Amperes.

The Control Network

As discussed above, the output voltage of the power supply and therefore the current delivered to the load may be adjusted by varying the value of resistor R4 as seen in FIG. 3. This type of control may be obtained by simply placing a potentiometer between the adjust lead of the regulator and ground. However, in the present design, a more specific circuitry is implemented, which will allow the value of R4 to be reduced every time a failure is reached. This implementation allows the force viewed by the user to drop when the point of failure is reached.

In the present embodiment, the torque motor is capable of delivering forces ranging from 0 to 150 pounds in 10 pound increments. This is obtained by a resistor network in which each resistor corresponds to a specific output voltage, and thus a specific force. Each resistor includes and individual switch. However, a large number of switches is not suitable for use by the user during the course of his exercises. Therefore, the switches are provided by 16 open collector buffers. The use of an integrated chip No. LN7407 is suitable, which contains 6 such buffers per chip. Therefore, to accommodate all 16 resistances in a network, 3 such chips will suffice.

An open collector buffer is basically an electronic switch, and can be considered a buffer because the input is equal to the output. The term open collector is suitable since the output of the buffer is a transistor, the collector of which is connected directly into the stage being driven by the buffer.

A simple manner of examining the mechanism behind the open collector buffer is illustrated below.

If the input to the buffer is high, then the base of the transistor receives a low signal. This would cause the transistor to be cut-off, and thus place an open circuit from output to ground. If the input to the buffer is low, then the base of the transistor will receive a high signal. This would cause the transistor to be saturated, and ideally, this would be seen as a short circuit from output to ground.

This is a relatively easy and simple way of providing the switches that would be used to connect each resistor to ground. The next step is to send the correct signal to the correct buffer for each selected force. Therefore, if the user desires a force of 120 pounds, this would require that the input to buffer 12, and only 12, go low, while the inputs to the remaining buffers remain high. A 4 to 16 line demultiplexer (integrated circuit DM74LS154N) is used to serve this purpose. A 4 to 16 line demultiplexer possesses 4 input or address lines, and 16 outputs. It also has 2 more inputs, known as enable inputs. With the particular circuit used, both of these inputs must be low in order for the demultiplexer to function properly. If either one of these 2 inputs is high, then all of the outputs stay high regardless of what the inputs on the address lines may be. If both enable lines are low, then the output corresponding to the binary number placed on the address line will go low. The enable inputs prove to be very useful as will appear more fully hereinafter. For example, if the number 1100 is placed on the input line, then the output number 12 would go low while the others would remain high. This is exactly the type of decoding that is required by control circuitry to be discussed hereinbelow. By feeding each output of the demultiplexer into an open-collector buffer, the proper resistor may be connected to ground by simply applying the correct inputs to the demultiplexer.

Referring to FIG. 4, the circuit is able to connect the proper resistor to ground by placing the correct binary code on the address lines of the demultiplexer. The device used for this purpose is a 3×4 numeric keypad with an LED display capable of converting numbers from base 10 to base 2. The input of the keypad is provided by pushing the correct digits. The keypad has 16 output lines representing the following numbers.

| | | | |
|---|---|---|---|
| 10 | 20 | 40 | 80 |
| 100 | 200 | 400 | 800 |
| 1000 | 2000 | 4000 | 8000 |

Referring to the chart above, a model 612A numeric keypad (ITT) operates in the following manner. The 16 outputs always remain high when not in use. However, if the user i.e. would enter the number 420, then corresponding output lines labeled 400 and 20 would go low. Thus, any number from 0 to 9999 is able to be converted to a binary code. (0 would cause all outputs to remain high, while 9999 would cause outputs 1, 8, 10, 100, 800, 1000 and 8000 to go low, leaving the remaining lines high).

Since the present device is concerned only with numbers ranging from 0 to 150, in 10 level increments, only the following 5 lines need be used: 10, 20, 40, 80 and 100. However, when trying to interface the keypad with the control circuitry, a number of problems must be resolved. As previously stated, if 70 pounds of force is desired, then the input to the demultiplexer should be a 0111 signal or the binary equivalent of the decimal number 7. Initially, the keypad cannot serve this purpose. Normally all lines would be high, as shown below.

| | | | |
|---|---|---|---|
| 80 | 40 | 20 | 10 |
| High | High | High | High |

However, when the number 70 is entered, the keypad keeps output line 80 high while sending the rest low, or, the following would occur:

| | | | |
|---|---|---|---|
| 80 | 40 | 20 | 10 |
| High | Low | Low | Low |

In other words, the binary code 1000, instead of 0111, would be sent to the demultiplexer. This, of course, is exactly the opposite of what is required. The problem is corrected by feeding each output of the numeric keypad into an inverter. This causes all lines to stay low when unused. With this configuration, if the number 70 is entered, then the output of the keypad would be 1000 (not including the 100 line), and thus become 0111 after being inverted, exactly what is required. A second problem is somewhat more serious. A 4 to 16 line demultiplexer has 4 input or address lines, and 16 outputs, so that a 4 bit binary code can provide 24 or 16 different numbers. However, once again, this is not how the keypad functions. Up to and including the number 90, there is no problem. However, when the number 100 is entered, the keypad instead of sending code 1010, as is required sends the code 10000. In other words, 100 is not modelled as the combination of 80 and 20; but rather an entire separate line exists for 100. The chart shown in FIG. 15 indicates the signals the keypad would send in comparison to the signal the demultiplexer requires to receive for proper functioning.

THE FEEDBACK NETWORK

Figure 6:
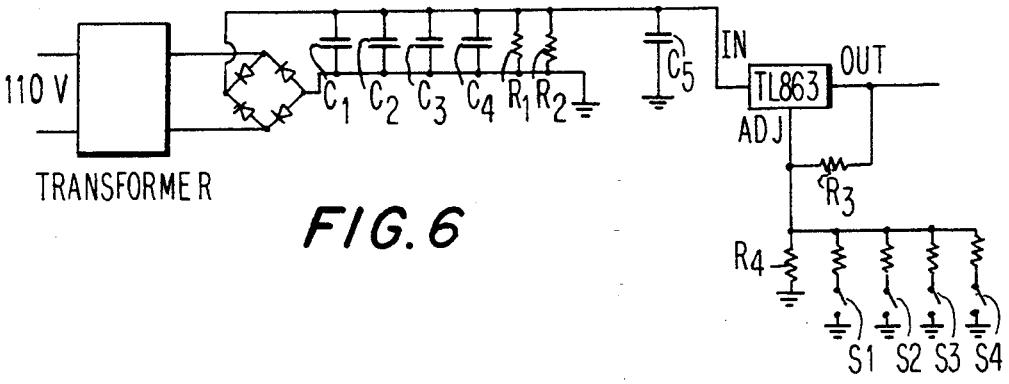
FIG. 6 is a schematic diagram of a modified power supply.
Figure 7:
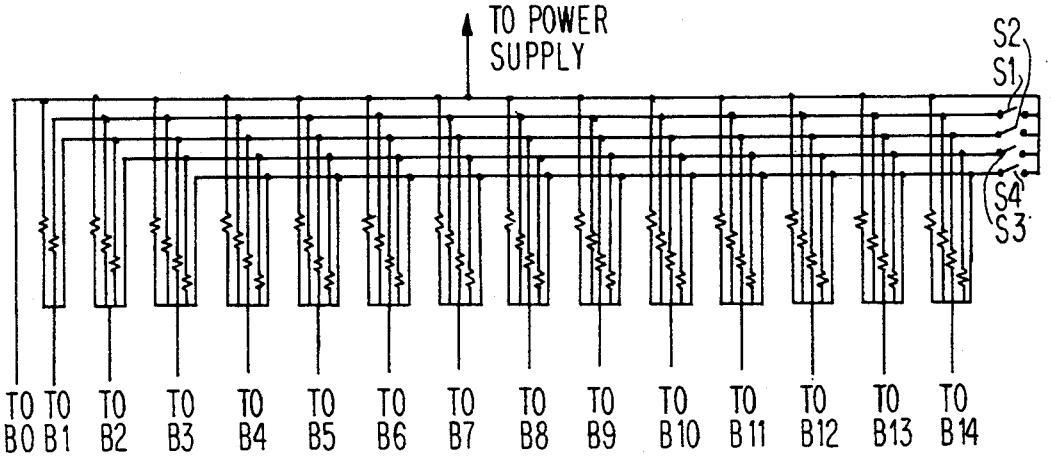
FIG. 7 is a schematic diagram of a modified resistor network.

The most significant aspect of the device is that it will be able to recognize when the crucial point of muscle failure is reached, and thus lower the force seen by the user. As stated above, maximum progress and results can only be achieved when this point of failure is reached and then surpassed. In order to lower the force, the current through the load or DC motor, must be lowered. This can be achieved by lowering the value of resistor R4 (see FIG. 6). The simplest way to reduce the value of a resistor is to place another one in parallel with it. Since it is desired that the device be able to undergo four such reductions in force, the value of R4 is lowered 4 times. This is achieved by implementing the circuitry to include S1–S4. Switches S1 to S4 are provided by four 12 volt DC relays. Closing each switch every time the failure point is reached, would result in the value of R4 to be reduced. However, it must be noted that the device includes 16 resistors representing a different force. Therefore the same arrangement shown in FIG. 6 must be realized for each individual resistor. To do so results in the modified resistor network shown in FIG. 7. The network operates according to the following sequence. First the control network is used to enable one group of resistors, and one group only. For example, if a force of 120 pounds is desired, then output 12 of the control network would go low. This would enable resistor group 12 in FIG. 7. However, it must be pointed out that only the first resistor in this group would be activated. The other four resistors would only be connected to ground by closing switches S1 to S4. Furthermore, in order for these switches to close, the failure point must be reached four times; each closing of switches S1 to S4 representing figure point 1 through 4 being reached.

Thus, the feedback network must recognize that the failure point is reached and then allow the sequential "turn-on" of the relays. At this point, several factors must be considered. Once a reduction of force is implemented, the reduction remains on for the remainder of the set of exercises. In order for the second relay to turn-on, signifying reduction 2 has occurred, the first reduction must have occurred prior. After the fourth reduction has been achieved, the force provided by the machine must be zero.

Figure 8:
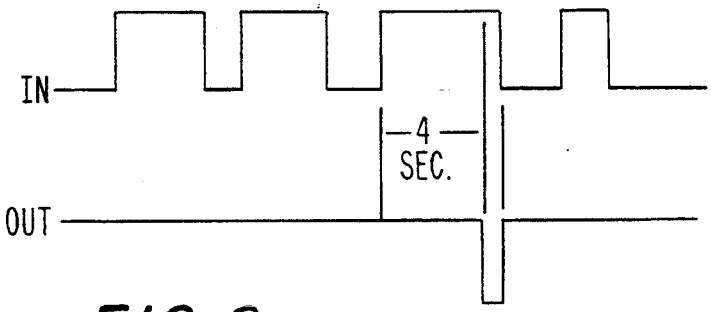
FIG. 8 is a timing diagram.

In order to insure that the three constraints above listed are never violated, each relay is driven by a programmable timer (the integrated circuit LS7210). Each timer is programmed to exhibit a delay of 3 to 4 seconds. This value was chosen after it was experimentally determined that this was the average time required to complete a repetition. If the person fails to complete a full repetition in this time span, it may then be safely assumed that the point of failure has been reached. All of the timers function in accordance with the diagram shown in FIG. 8.

Figure 9:
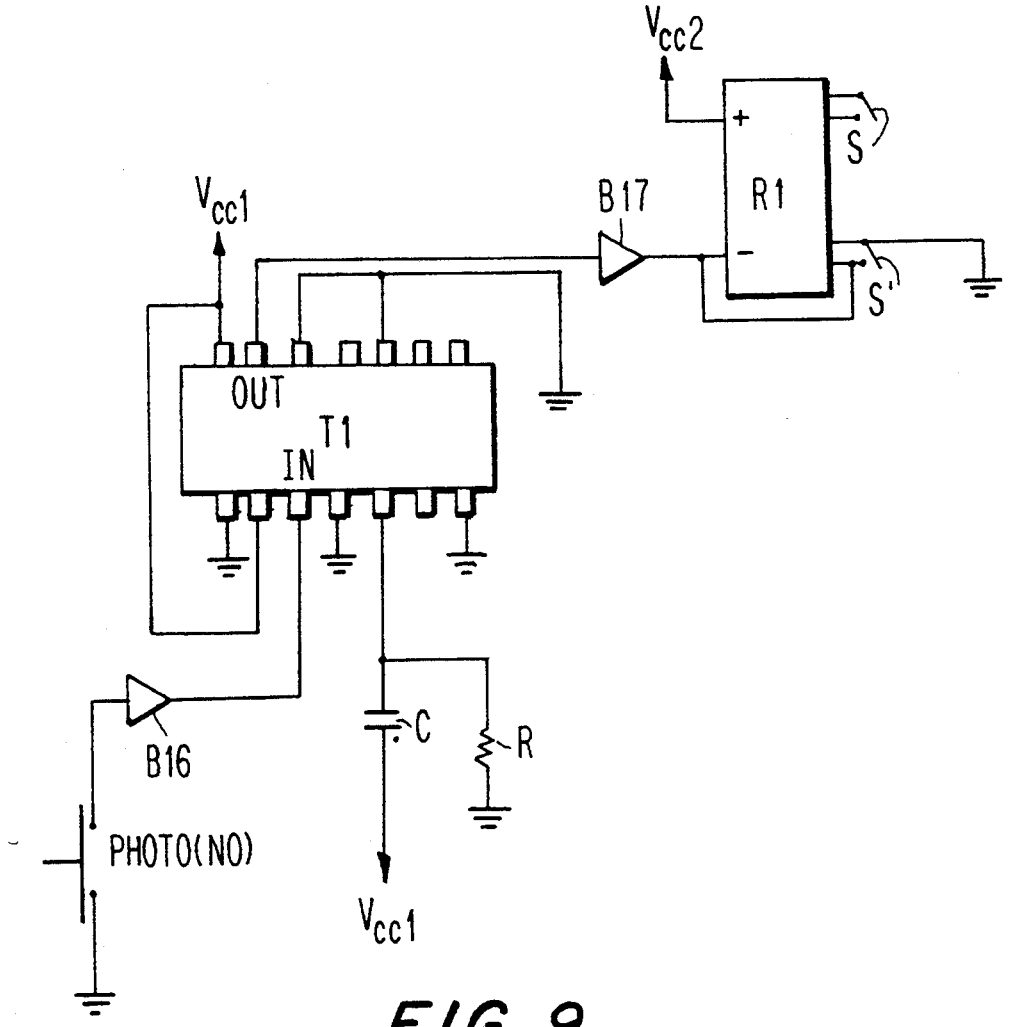
FIG. 9 is a schematic diagram of a delay circuit.

As long as a low input is provided, the output of the timer will be high. From the moment the input goes high, the output would go low after a four second delay. The delay circuitry of FIG. 9 shows one stage of the feedback network. It may be seen that as long as the timer receives a low input, the output stays high which may turn relay 1 off and switch 1 open. However, if the input timer goes high, and remains high for 4 seconds or more, then the output goes low and this causes relay R1 to turn on and thus close switch 1.

This provides the first reduction in force. However, it must now be insured that this reduction remains in effect even if a full repetition can now be completed. A full repetition could now be completed since the point of failure has been reached, and a smaller force is now being provided by the machine. Since the relays serve as double pole, double throw switches, the first switch S1, is used to reduce the force, while the second switch, Si is used to keep this reduction operative. This is achieved by grounding one lead of the switch and connecting the other lead to the relay input. If the relay input is high, then the relay is off. If the input goes low, then the relay turns on and switches S1 and S1' close. If the input to the relay would go high, then the relay would shut off. This is prevented by switch S1' which provides a low input to the relay irrespective of the output of the timer.

Figure 10:
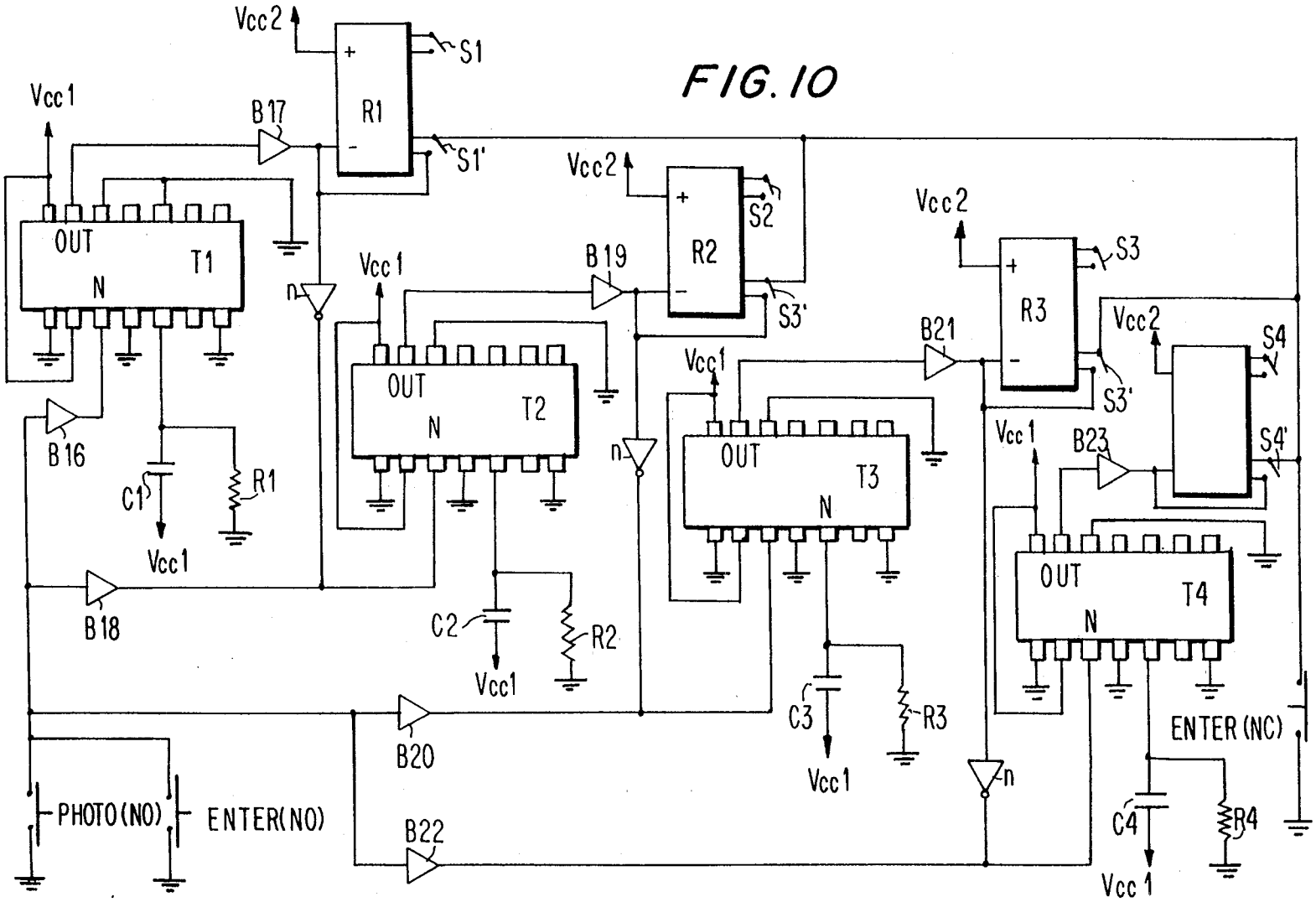
FIG. 10 is a schematic diagram of a feedback network.
Figure 11:
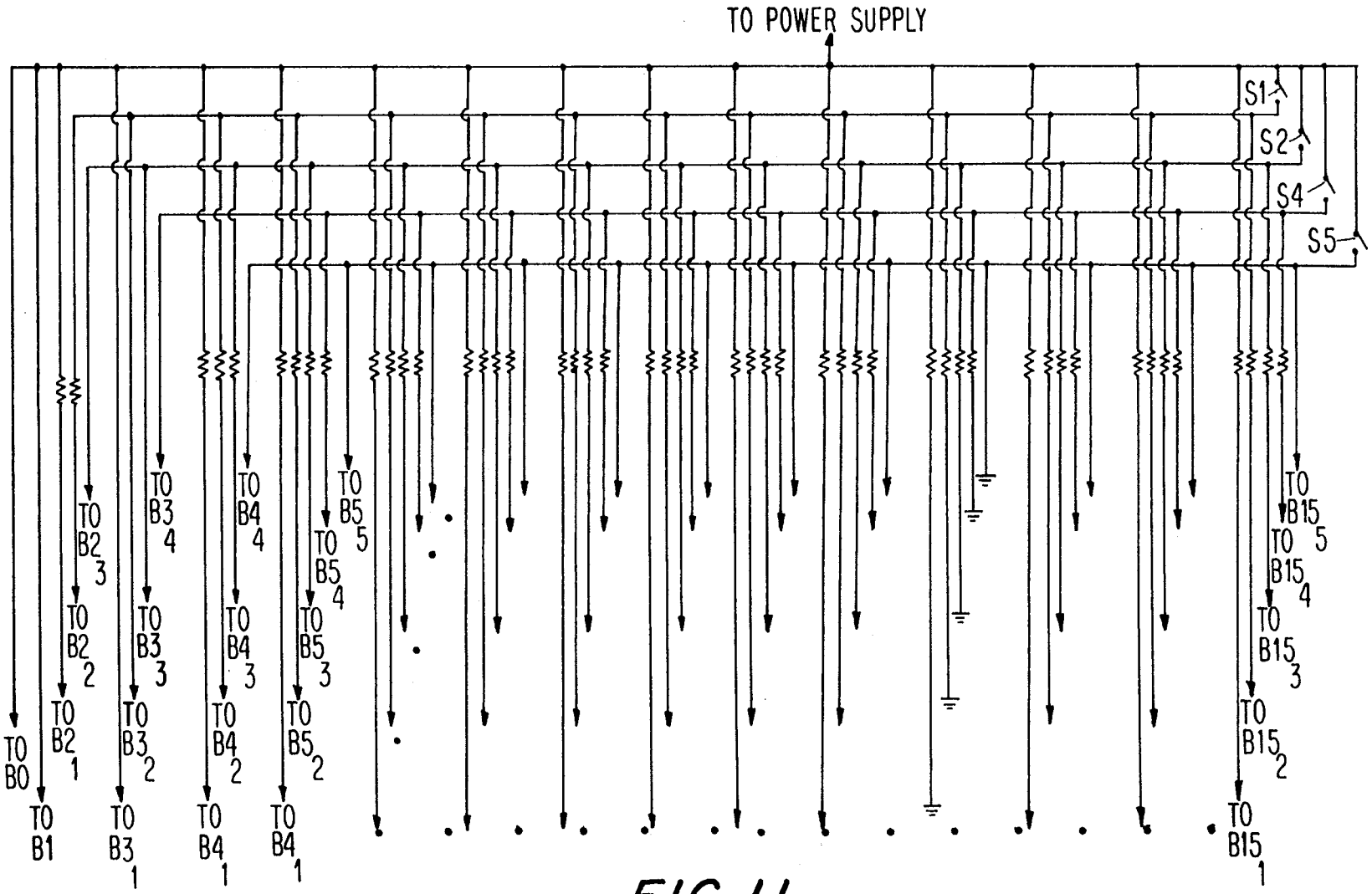
FIG. 11 is a schematic diagram of a modified resister network.
Figure 12:
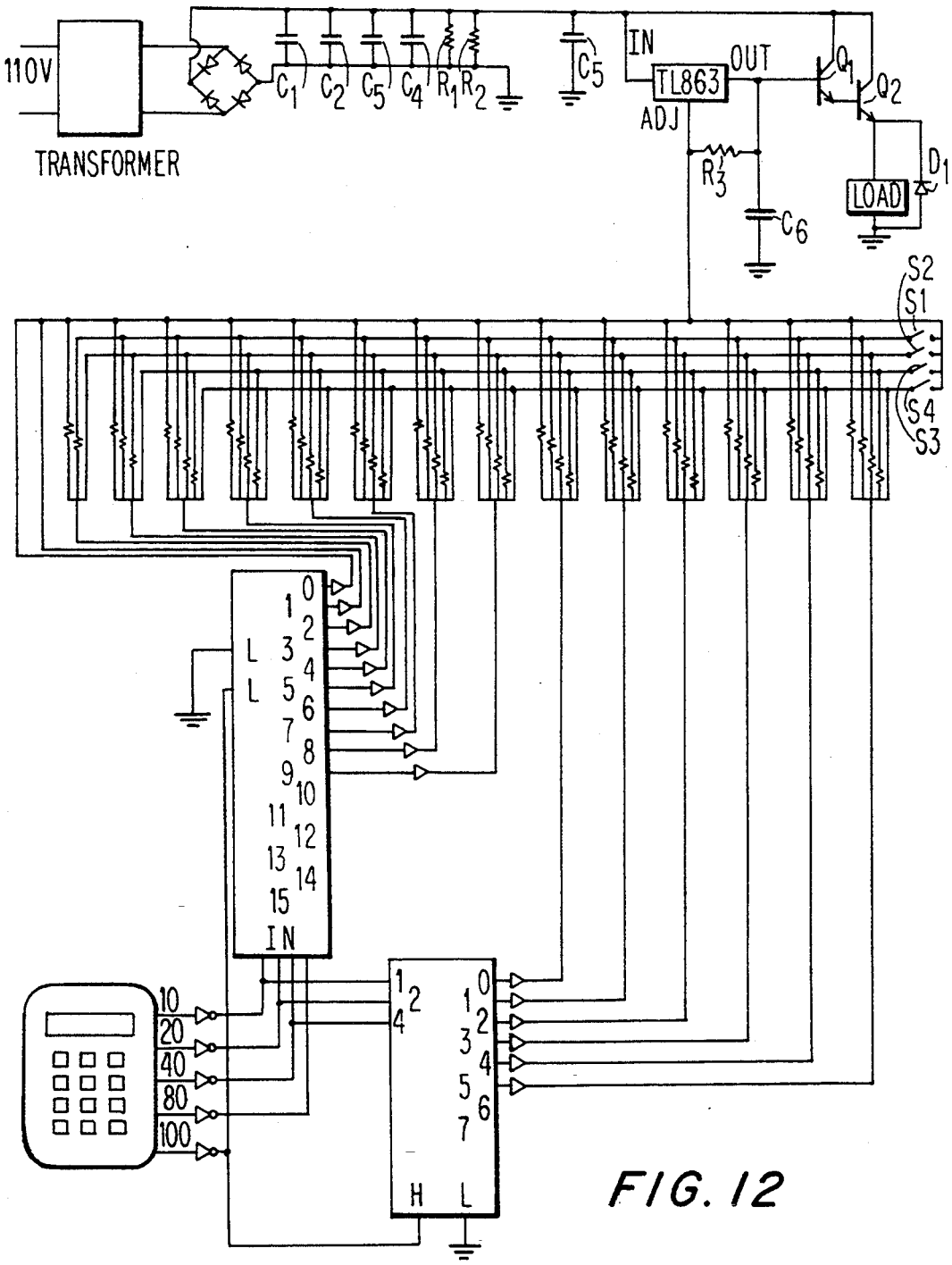
FIG. 12 is a schematic diagram of a modified control network.
Figure 13:
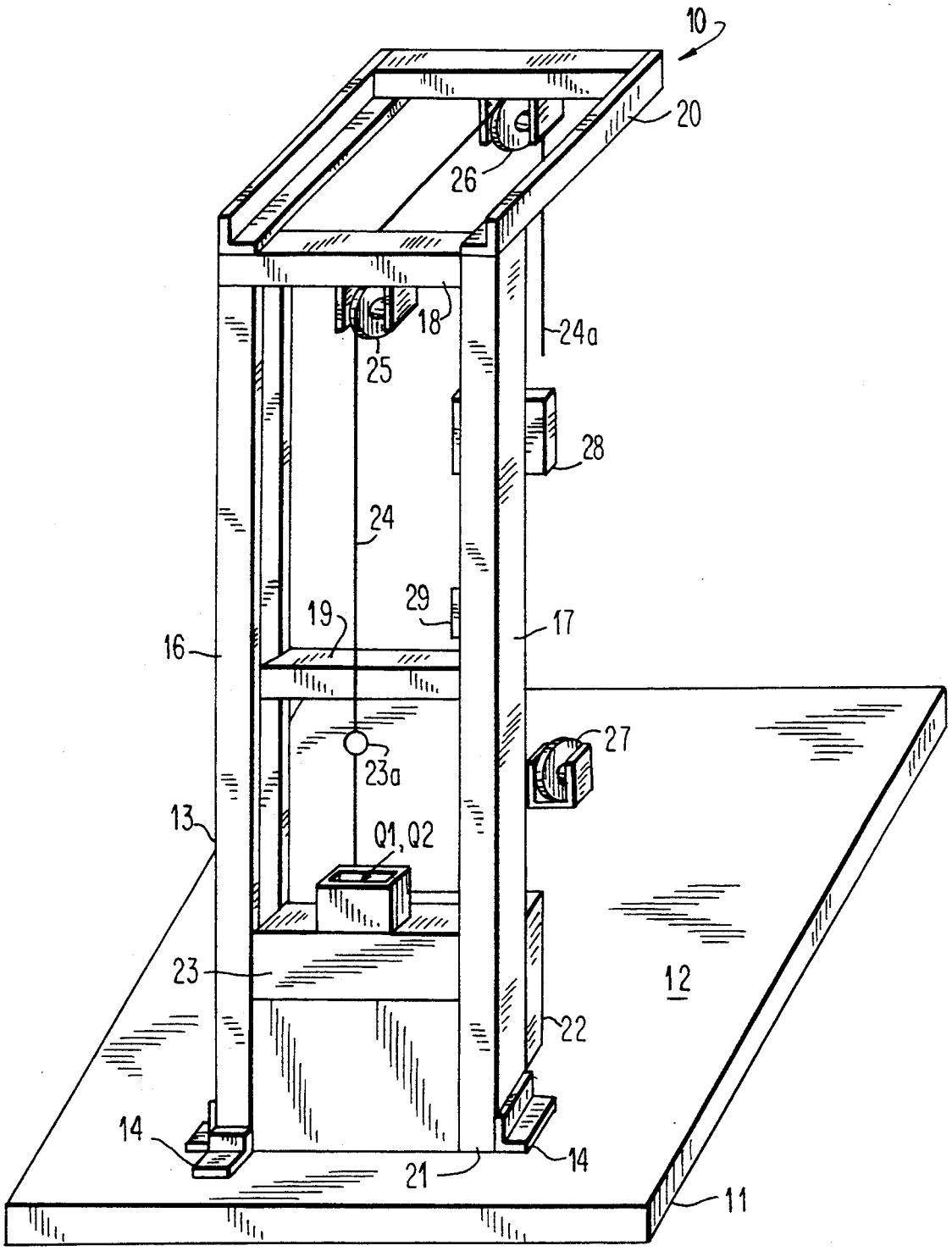
FIG. 13 is a schematic perspective view of an exercise device embodying the invention.

The second requirement above mentioned is that the second stage of the feedback circuit should not turn on before the first stage. This is achieved by placing an inverter between each stage as shown in FIG. 10. So long as the output of the first timer is higher than that of the second, the second relay remains off. The output of the timer is fed to an inverter whose output is placed on the input of the second timer. This timer will always receive a low signal and thus keep stage 2 off as long as stage 1 is off. Assume that the point of failure has been reached and the first stage turns on. The output of the inverter, and therefore the input to the second timer goes high. Unless something is done to provide a low input to the second timer within a four second span, the second stage will also turn on, thus reducing the force once again. However, a low input can still be provided by closing the photoscanner switch. Once again, switch S2 is used to decrease the force when the failure point at the new weight is reached, while S2' is used to keep this reduction on once it takes place. By cascading four such circuits four reductions in force are achieved seriatim. The last switch, S4, places a short circuit to ground thus reducing the force to 0. This resolves the third requirement of the feedback network.

At this point, it may be useful to follow through the steps involved to observe how the control network functions from the moment a weight is entered on the keypad to the point when this force is actually produced.

Assume a user enters the number 50, representing a desired force of 50 pounds. This will call the output of the keypad to be 11010. After being inverted, this signal is changed to 00101. Since the first bit is low, this enables demultiplexer 1 and disengages the second demultiplexer (the 3-to-8line). Since the second multiplexer is now disabled, it is unimportant with regard to the status of the address lines. All outputs will be high which will keep the resistors R10 to R15, inclusive, disconnected. However, the first demultiplexer, being enabled, receives the input 0101 on the address lines. This causes output 5 to go low while the others remain high. This action connects R5 to ground, and thus creates a specific output voltage. This voltage causes a current flow which produces 50 pounds of force.

Assume the number 120 is entered as the desired force in pounds. Once again, the following sequence occurs:

120 →*KEYPAD*→01101→*INVERTED*→10010

HIGH first bit disables demultiplexer 1 copnsequently ENABLING Demultiplexer 2. Thus, demultiplexer 2 receives a 010 on its input lines out 2 goes LOW resistor R12 is connected to ground and 120 pounds of force delivered.

Figure 5:
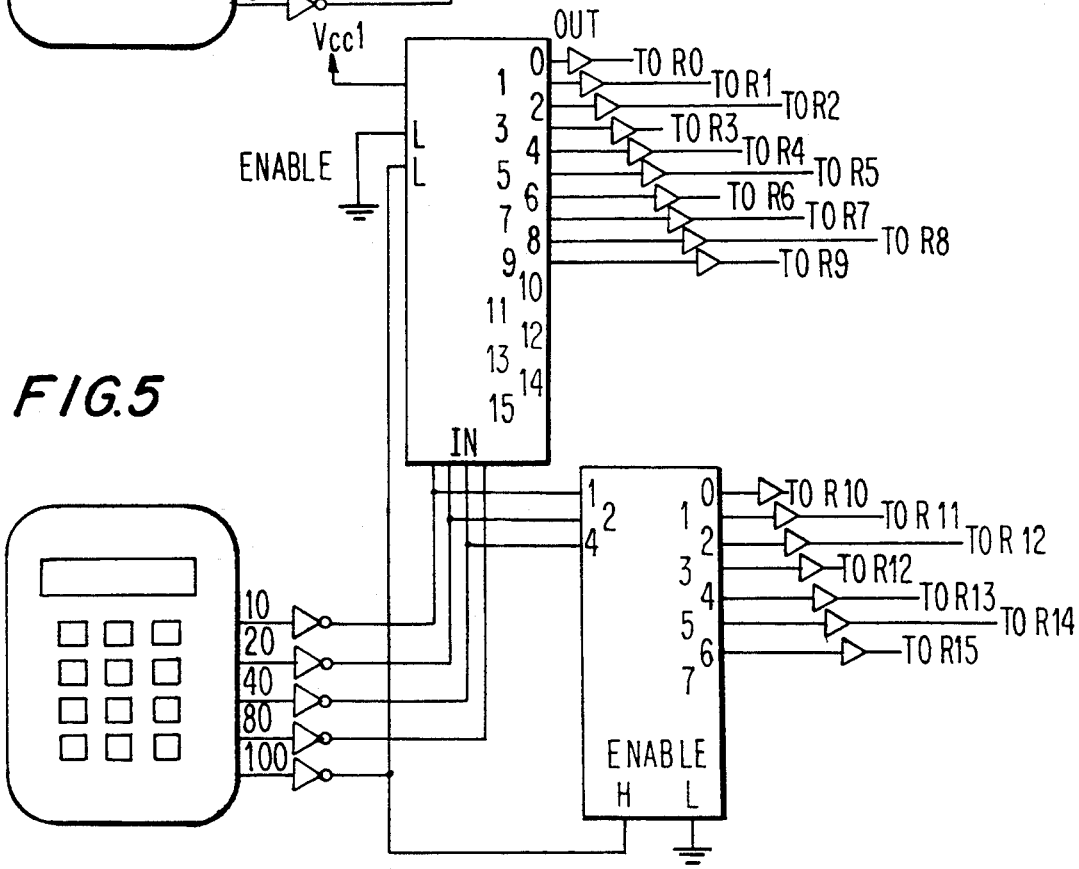
FIG. 5 is a schematic diagram of a modified control network with associated keypad.

Thus, up to and including the number 90, the interface between the keypad and the demultiplexer is correct. In other words, only the first four lines of the keypad are used. However, for numbers greater than and including 100, the signals sent by the keypad and the ones required by the demultiplexer no longer match. When number 120 is entered on the keypad, it sends the signal 10010, while the demultiplexer is looking for 1100. At this point, the enable lines of the demultiplexer become useful and solve the problem. The original demultiplexer is used to provide forces ranging from 0 to 90 pounds, while a second 3 to 8 line demultiplexer, (the integrated circuit SN74LS138N) is used to control forces from 100 to 150 pounds. Line 100 of the keypad is hence used to enable or disable the correct demultiplexer. The 3 to 8 line demultiplexer also contains two enable lines. In order for the demultiplexer to function properly, the first one had to be high while the second one low. If a code other than 10 is placed on the enable lines, all outputs will go high. This is illustrated in FIG. 5.

Refering now to FIG. 3, there is illustrated a typical device, the details of which can be varied within the scope of the invention. In includes a bottom platform 11, upon which the user stands on the upper surface. It is supported by two vertical uprights 16, 17 which are mounted to the bottom platform 11. Elements 18, 20 were used to provide placement for the pulleys 25, 26. At the lower end of the uprights 16, 17 there is a motor encasement 22, and a separate enclosure 23 for the control circuits. A flexible cable 24 extends from the motor and is entrained over the first and second pulleys 25, 26 in known manner. The end of the cable 24 is attached to an exercise handle 10. A keypad 27 may be located on element 17 approximately at the eye level of the user, and photo switch 21 may also be positioned in alignment with the cable 24 to sense muscle failure by detecting the motion of ball 19 attached to cable 24. It will be noted that the user need only insert an initial weight load using he keypad 27, and subsequent adjustments are automatically performed upon the sensing by the photo switch of each of four levels of muscle failure, thus enabling the suer to continue exercising within the absolute limits of his physical ability.

Figure 14:
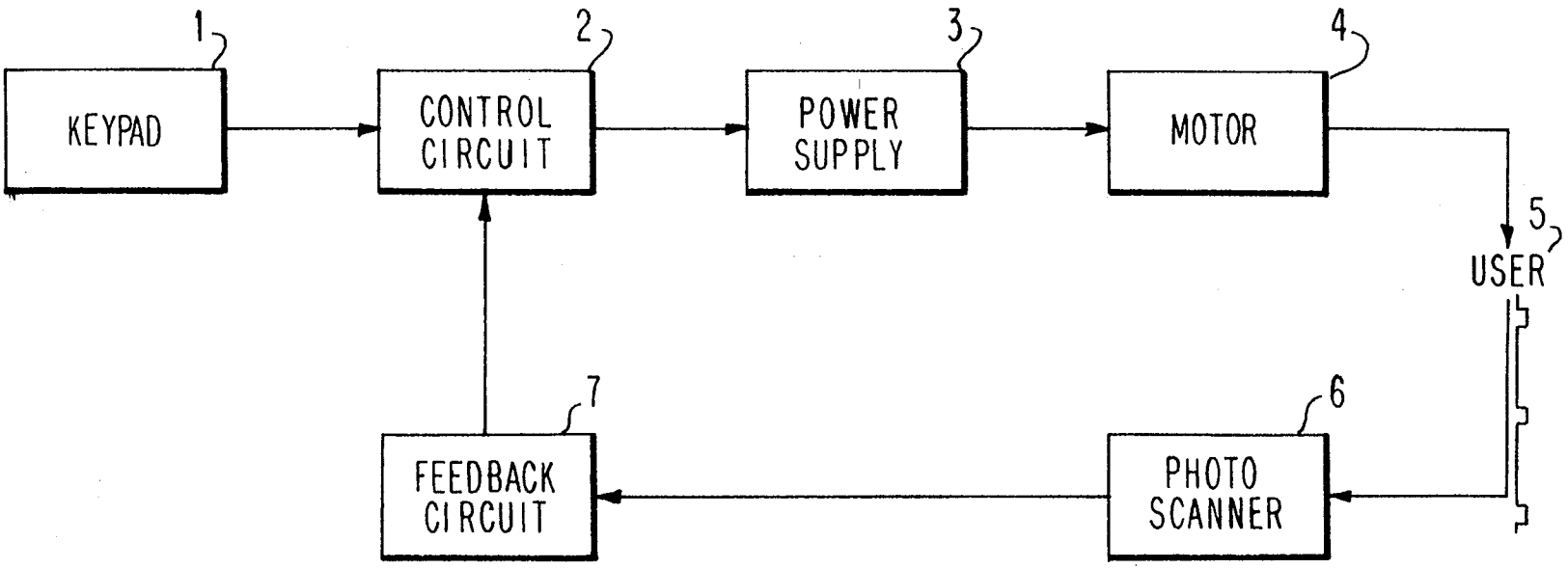
FIG. 14 is a block diagram showing the operation of the disclosed embodiment.

Referring to FIG. 14, keypad 1 is used to send a signal to the control circuit 2, which acts on the power supply 3, causing it to produce a specific output voltage. The output voltage establishes the torque produced by the motor 4 against which work is being done by the user. As the user slows down, the photoscanner 6 detects a lower frequency. When the frequency of the repetitions being performed become smaller than a preset amount, the feedback circuit 7 acts on a control circuit 2, to lower the output voltage and therefore the force against which the user is working.

We wish it to be understood that we do not consider the invention to be limited to the precise details of structure shown and set forth in this specification, for obvious modifications will occur to those skilled in the art to which the invention pertains.

We claim:

1. In a weight lifting type exercise device, including a torque motor for providing the equivalent of a weight load to a user, and means for altering the effective load with respect to said user, the improvement comprising: first means initially determining a desired constant weight load by determining a current level supplied to said torque motor; second means for monitoring the performance of said user in performing repeated exercise cycles, said monitoring means determining the point at which said user has reached muscle failure with respect to an initial load; a resistor element initially controlled by said first means, and responsive to said second means for diminishing the initial current in predetermined increments to vary the effective load to said user upon the reaching of successive points of muscle failure relative to a previous load level.

2. The improvement in accordance with claim 1, in which said first means includes a digital keyboard.

3. The improvement in accordance with claim 1, in which said second means includes a photosensor.

4. The improvement in accordance with claim 3, in which said photosensor is coupled to a timing device.

5. The improvement in accordance with claim 1, in which a final increment reduces the current to the torque motor to zero.

6. The improvement in accordance with claim 1, in which said monitoring means reduces the effect of load current by supplementing the effective electrical resistance existing at an immediately previous adjustment.

* * * * *